US007703508B2

(12) United States Patent
Orban

(10) Patent No.: US 7,703,508 B2
(45) Date of Patent: Apr. 27, 2010

(54) WELLBORE FILTER FOR SUBMERSIBLE MOTOR-DRIVER PUMP

(75) Inventor: Jacques Orban, Moscow (RU)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 11/869,948

(22) Filed: Oct. 10, 2007

(65) Prior Publication Data

US 2008/0110614 A1 May 15, 2008

(30) Foreign Application Priority Data

Oct. 11, 2006 (RU) ..... 2006135826

(51) Int. Cl.
*E21B 43/00* (2006.01)
*E21B 33/12* (2006.01)

(52) U.S. Cl. ..... 166/105.1; 166/105; 166/106; 166/202; 166/227

(58) Field of Classification Search ..... 166/106, 166/202, 227, 105; 277/335
See application file for complete search history.

(56) References Cited

U.S. PATENT DOCUMENTS 2,665,644 A * 1/1954 Wells
2,806,537 A * 9/1957 Sparks, Sr.
3,963,073 A * 6/1976 Laval, Jr.
4,869,320 A * 9/1989 Kamilos
4,977,958 A * 12/1990 Miller
5,314,018 A * 5/1994 Cobb
6,330,915 B1 * 12/2001 Moya
6,719,050 B2 * 4/2004 Longacre
7,086,473 B1 * 8/2006 Bangash
7,373,991 B2 * 5/2008 Vaidya et al.
7,380,592 B2 * 6/2008 Atkins et al.
2002/0153142 A1 * 10/2002 Eslinger et al.
2002/0189809 A1 * 12/2002 Nguyen et al. ..... 166/278
2003/0121663 A1 * 7/2003 Weng
2007/0027245 A1 * 2/2007 Vaidya et al. ..... 524/424

FOREIGN PATENT DOCUMENTS

RU 2102585 1/1998
RU 2217580 11/2003
SU 1660587 6/1991

* cited by examiner

*Primary Examiner*—Jennifer H Gay
*Assistant Examiner*—Yong-Suk Ro
(74) *Attorney, Agent, or Firm*—Kevin B. McGoff; Tim Curington; Zhanna Prokofieva

(57) ABSTRACT

A technique utilizes a well filter with a submersible motor-driven pump. The system comprises an elongated filter housing in which a cylindrical filtering element is installed. A fixture is provided for fastening the elongated filter housing to the pump. The filter housing also comprises at least one fluid intake port positioned to allow entry of fluid into the elongated filter housing. A deformable sealing element is installed along an outer surface of the elongated housing and serves to direct fluid flow.

13 Claims, 5 Drawing Sheets

WELLBORE FILTER FOR SUBMERSIBLE MOTOR-DRIVER PUMP

FIELD OF THE INVENTION

This invention is related to geophysics, in particular, to geophysical methods of well survey, and can be applied for removal of wellbore liquid that fill the well, during the well logging process.

This invention characterizes a filter for solid particles; which can be mounted at the suction side of submersible motor-driven pumps. The formation fluid first passes through the filter and then goes to the submersible motor-driven pump. The design of this wellbore filter allows capturing of large-sized solid particles, e.g., proppant particles (following the formation fracturing process) and/ or debris that remained in place after perforation job. This filter is featured by a limited volume of accumulating particles; however, once the throughput capacity for fluids is exhausted, the filter in concern can be used for operation in a bypass mode. In this case, fluids to be removed bypass the filter and enter the suction hole of the submersible motor-driven pump.

BACKGROUND

A submersible motor-driven pump is often used for fluids removal/ production from wells after operation of perforation and/or formation fracturing. In such cases, rock debris and proppant particles often continue to penetrate the well from the fractured/perforates formation over a certain period of time. Small debris remaining after perforation typically enter the well from the formation over a rather short period of time; however, in case of the formation fracturing, the reverse flow of proppants could last over an extended period ranging from a few days to several weeks from the production start day.

Dependent of the pump position above the peroration site, some solid particles could reach the suction hole of the electrical submersible pump. Thereafter, they will start passing through the pump section carried by fluid. Since the fluid velocity in the pump system is rather high, these particles could cause a significant erosion of impellers and diffusers.

Following the perforation and before the installation of an submersible motor-driven pump pump, the stimulated well is typically subjected to cleaning.

In depleted formation, the lift technology is usually required. In these circumstances, wells can be cleaned through arranging the circulation of a fluid with desired composition via a flexible coil tubing; the said fluid can lift upward the suspended heavy particles. In other cases, a temporary submersible motor-driven pump is installed in the well to ensure hydrocarbons production alongside with the well cleanup (and fracturing). Meanwhile, it is known in advance that the installed temporary submersible motor-driven pump has to be replaced with a new submersible motor-driven pump following a rather short operating period (typically, several weeks).

The above-mentioned well cleanup technologies are expensive and require idling of the well (while the flexible coil tubing is in operation or submersible motor-driven pump is being replaced).

Electric submersible pumps are known to be damaged by small-sized particles in the course of operation. These damages limit the service life of submersible motor-driven pump and the pump should be replaced. The pump replacement procedure is rather expensive and required idling of the well (at least for a period when works in the well are performed).

To handle the problem of declining capacity of submersible motor-driven pump because of erosion by large-sized particles, the suction line of submersible motor-driven pump is sometimes furnished with filters. A typical issue that arises due to the filter operation is clogging after a certain period of operation; the filter clogging results in a reduced throughput or in a fully obstructed flow. So, submersible motor-driven pump and filters has to be removed from well for replacement and maintenance.

A wellbore fluid could contain (dependent on well type and treatment technology applied before the installation of an submersible motor-driven pump) three types of solid particles:

- solid particles originating during perforation. These solid particles could be represented by small debris of perforation tools, casing and cement as well as by various-sized rock debris coming from the well walls immediately after perforation (or in first moments of hydrocarbons production following the perforation). In case if some perforation technologies (with a positive pressure drawdown and at a highly depleted formation) are employed, the above-mentioned solid particles can go into the productive flow right from the start of the submersible motor-driven pump operation;
- proppant backflow. This issue emerges after the formation fracturing. Some proppant particles could be washed-out from the well at the initial stage of production. Information that at a total backflow of proppant in some wells in West Siberia could account for up to 2 tons (which corresponds to uncompacted 1 $m^3$) is available. The proppant particle shapes could deviate from an ideal spherical shape, and some particles are crushed during the formation fracturing closing. This means that particles with broadly varied sizes could enter the well. The proppant backflow could last several weeks, while the concentration of solid particles, starting with the first day of production, typically reduces to negligible levels;
- formation rock solid particles. These particles are rather small and are produced together with the formation fluid. A percent concentration of solid particles in the produced fluid could remain constant over a long period of time. The percentage could attain 200 ppm (which corresponds to a significant volume of a daily flow rate of particles in case of high-yield wells, e.g., those with a daily yield of 5,000 barrels and above). It is a challenging to handle that amount of solid particles.

A wellbore filter design comprising a casing with circulating passages, filtering element mounted on the casing and designed with stringers with a wire coiling placed on the said string, a supporting ring shroud to rigidly fix the end surface of the filtering element mounted at the casing, and a crossover shoe, is known (RU, patent No. 2102585). Besides, it is furnished with an enclosure that forms a ring chamber with the casing and the crossover shoe, and a sleeve with radial passages and supporting elements placed inside the said ring chamber; some supporting elements of the sleeve are placed in the bushing radial holes, while the remaining supporting elements of the bushing are installed in the slotted openings of the casing; the enclosure and the sleeve are connected by cut-off elements. A sophisticated structural design and a lack of packing between the filter housing and the wellbore walls are the disadvantages of this filter design.

A filter for downhole submersible motor-driven pump comprising a casing with filtering elements and a sealing element (gasket) mounted at the housing to separate the intake and discharge parts of the filter is also known (SU, authorship certificate No. 1660587).

A low strength of the sealing element (distorts during installation procedure and creates leakage) is the obvious shortcoming of this engineering solution.

The most similar analogue to the disclosed design is the strainer for downhole pumps (RU, patent No. 2217580), which includes a housing with filtering elements and a sealing element to put the boundary between the intake and discharge parts of the strainer; the said sealer is designed in the form of a bell filter with a spherical collar mounted on it, with the said sealing element hinged to the filter housing.

The rigid structure of the sealing element creates problems with lowering the strainer to the well and may cause the damage of the said strainer. This damage creates leakage in the top part of the strainer.

The way of resolving the engineering issue is development of a new design of the wellbore filter.

BRIEF DESCRIPTION OF THE DRAWINGS

This invention is illustrated by graphic material, where.

DISCLOSURE OF THE INVENTION

The implementation of a new design of a wellbore filter makes the service life of submersible motor-driven pump longer.

Figure 1:
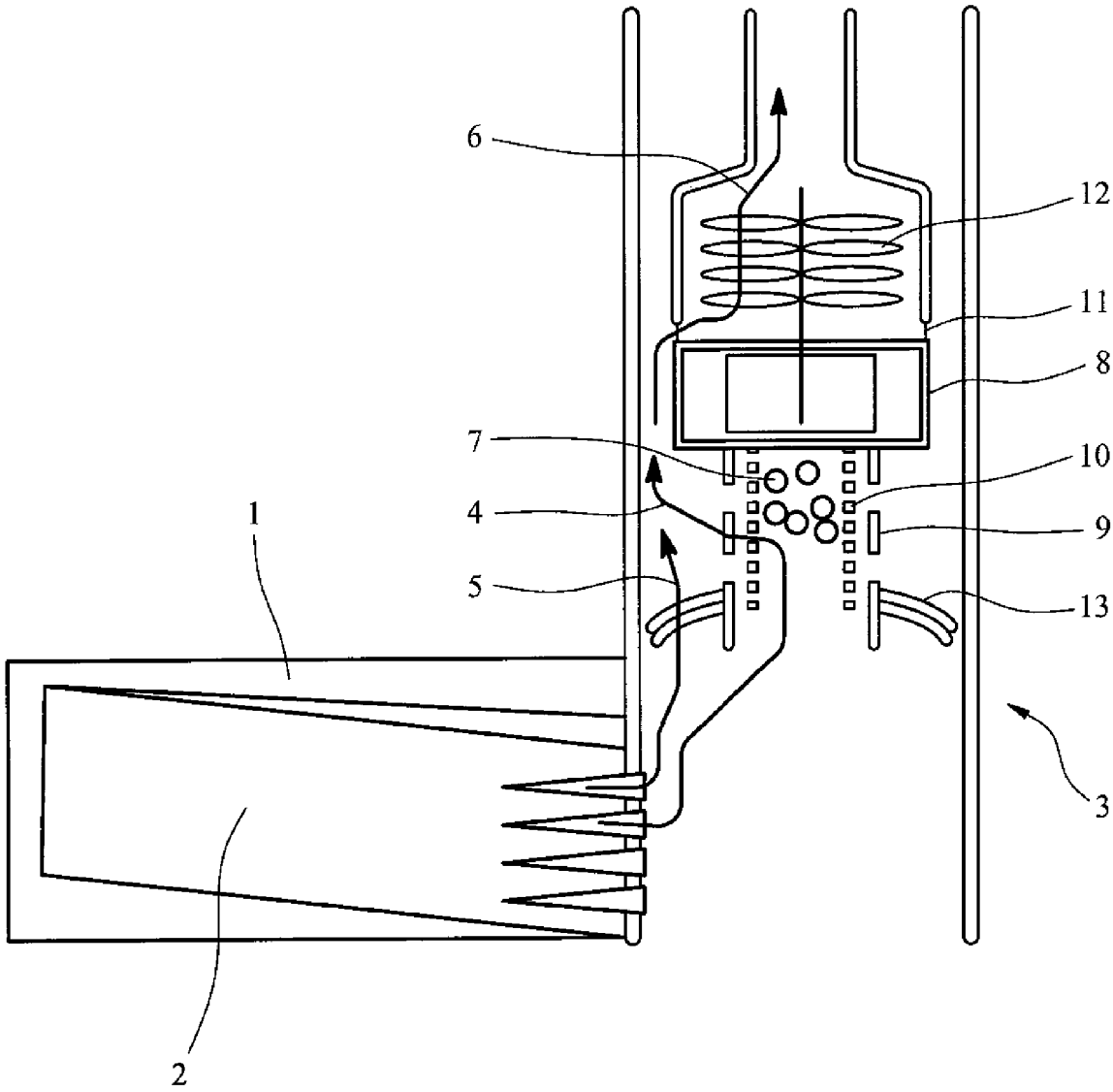
FIG. 1 presents the front view of the filtering system in the base version (a cross-section), FIG. 2 demonstrates the design of the sealing element.
Figure 2:
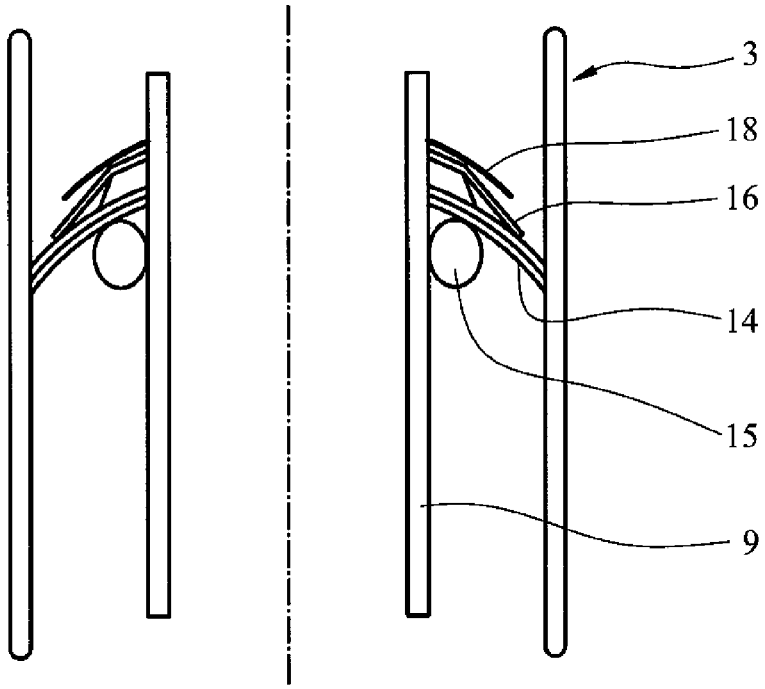
Figure 3:
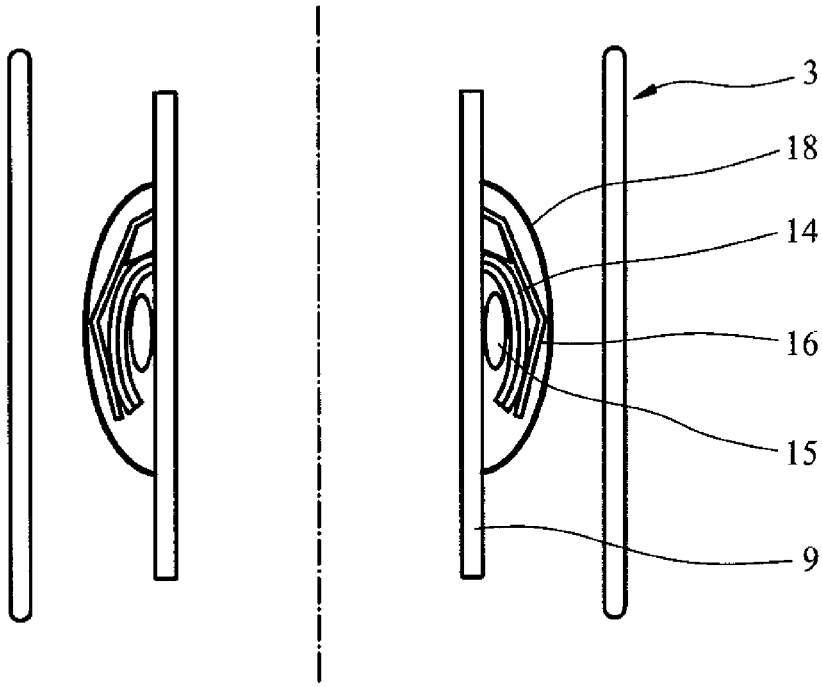
FIG. 3 is one of variants for sealing element.
Figure 4:
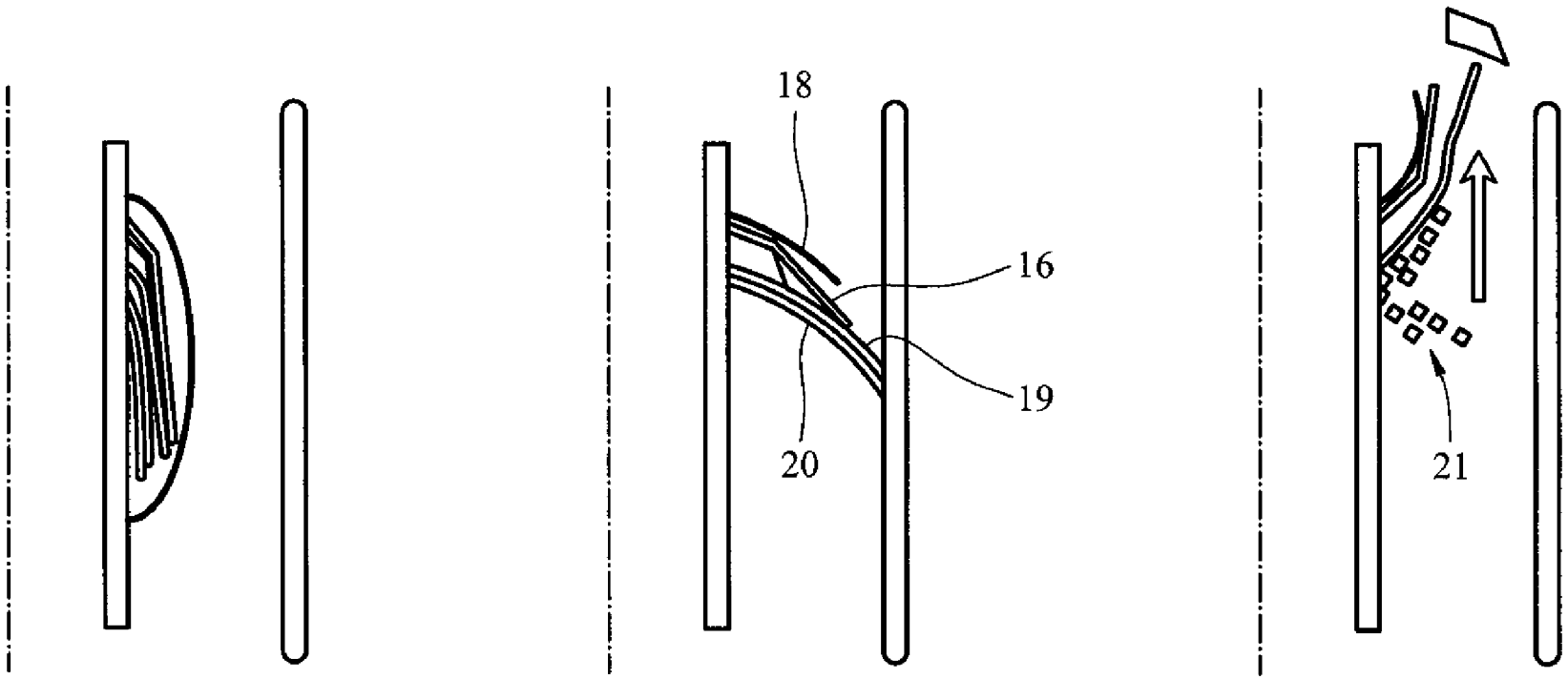
FIG. 4 shows the changes whilst operation for the sealing element depicted in FIG. 3.
Figure 5:
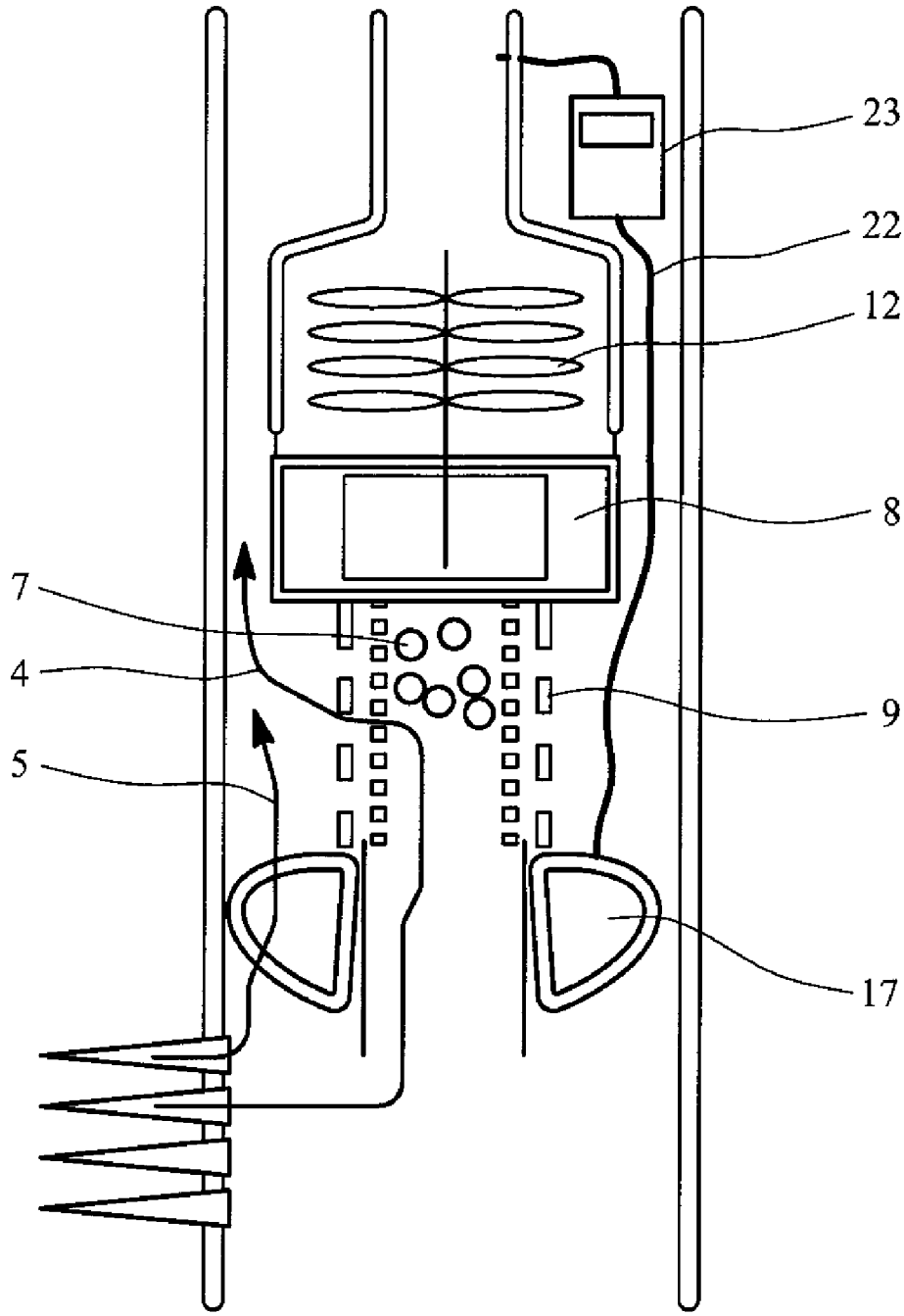
FIG. 5 presents a variant of embodiment.
Figure 6:
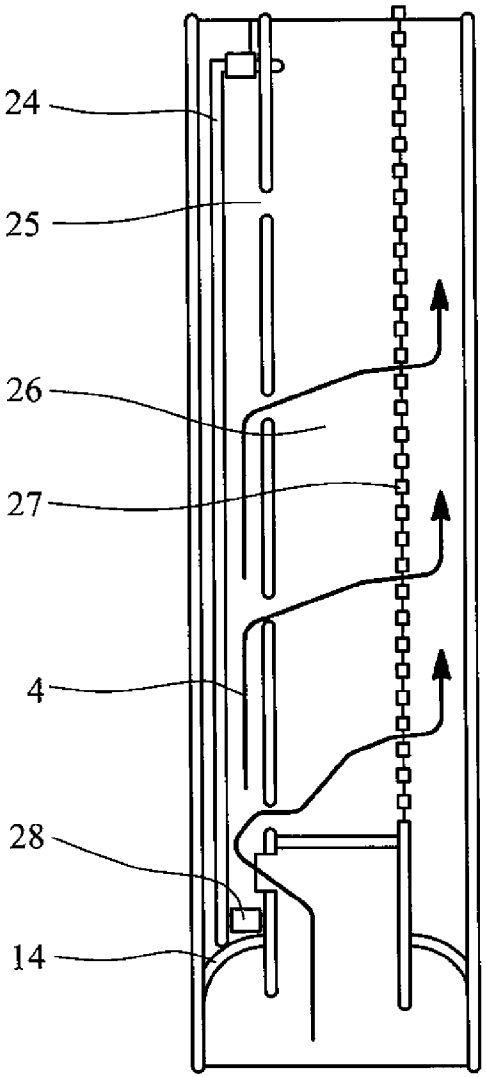
FIG. 6 depicts the top view for the operating filtering system.
Figure 6:
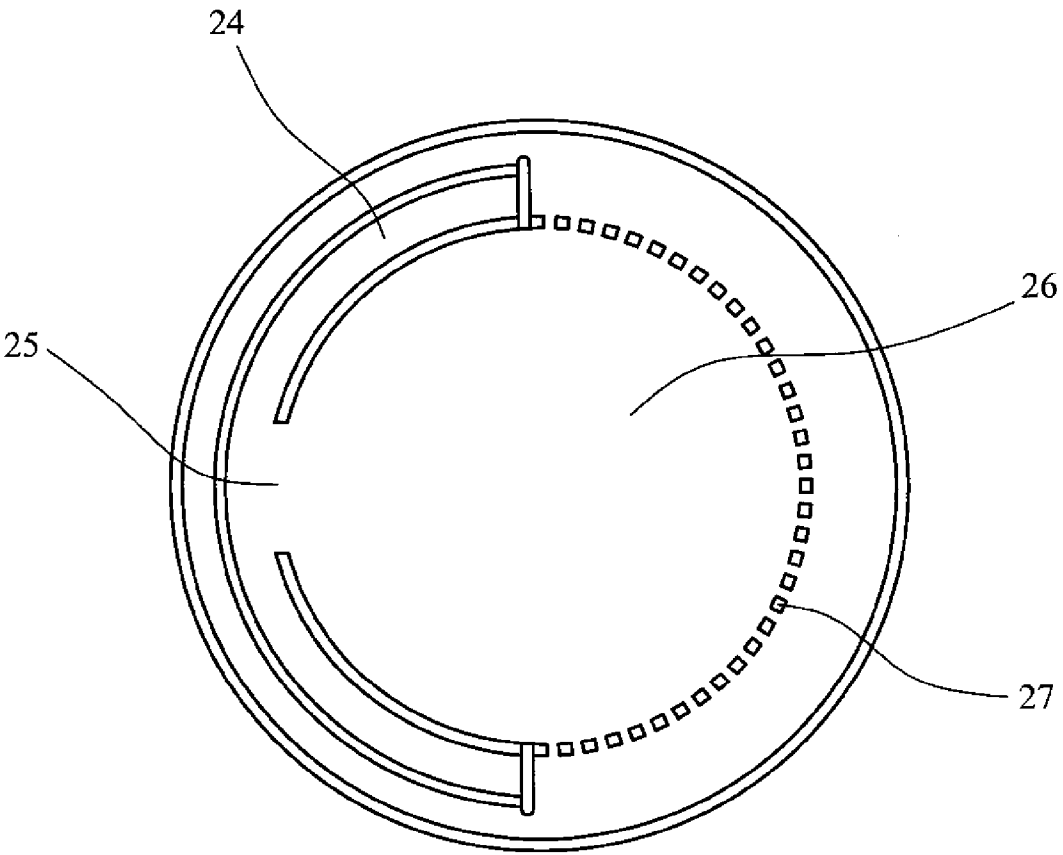

To reach the desired engineering target, it is proposed to use a wellbore filter for submersible motor-driven pump (FIG. 1), which comprises an extended cylindrical perforated housing with a cylindrical filtering element 11 installed; a fixture for fastening the filter housing to the pump is mounted at one end of the housing, while another end has at least one fluid intake port; a flexible-shape sealing element is installed inside the housing. When the pump is lowered to the well, the sealing element adjoins the filter housing in the operating state, it completely obstructs the space between the filter housing and the internal surface of the casing tube (FIG. 2). The initial flow 4 passes the trajectory shown in FIG. 1. In the preferred implementation option, the sealing element can be designed as a multi-layer packing tool. In this case, the sealing element generally includes at least two elements. The first part of sealing element is a flexible polymeric element in the form of concave cup 16; the second part of sealing element is a protective sheath (FIG. 3), which keeps the sealing element in compressed form while the filter is lowered to the wellbore, connecting to the submersible motor-driven pump and positioning in the well. Different design options for the said flexible polymeric sealing element are available. In particular, the said flexible polymeric sealing element can reinforced by organic and/or inorganic high-strength items (fibers, strips or wires) with thin rubber coating. The similar technique is used in production of car tires. The said flexible polymeric sealing element can also be designed with an internal cavity hosting a source of compressed gas, remotely controlled from the surface. The said protective sheath is generally made of easy-destructible materials which decays under the well liquid impact (polyethylene or polypropylene film bags) or under the impact of chemicals additionally injected to the well (if this sheath is a metallic mesh or foil (like aluminum or magnesium)). A third element made of environmentally shrinkable materials can be additionally attached to at the external surface of the cup 16 which, while the filter is positioned, is oriented upward in the well. In particular, this can be a gas-filled bag made of elastic material and glued (filled with gas) to the said upper surface of the cup. While contacting with the hydrocarbons-containing wellbore fluids, the gas bag looses its tightness, the gas releases from this bag, and the total area of the chamber (including the glued item area) reduces. The internal stress expands the flexible element (FIG. 4). An additional (fourth) element designed as an extending spacing ring or an item releasing gas medium while contacting with a well fluid can also be mounted on the internal surface of the cup. A ring made of a natural or artificial rubber swelling while contacting the hydrocarbons can be used as the above-said extending ring, whilst a lithium ring can be used as a substance emitting gas while contacting the well fluids. The dimensions of the above-mentioned additional elements are dependent on the cup material elasticity and size and wellbore diameter. The said flexible element can be designed as a mechanically activated compacting tool. In the preferred design implementation option, the mechanically activated compacting tool can be designed as an elastic cup with a mechanical activator, which actuates as soon as it contacts with well fluids, located on the inner surface of the said cup. The said mechanical activator can be available as a spiral spring, which in the original state (before lowering to the well) is put under stress by a holder (e.g., polyethylene tape) which decays in the well fluid. Also, the mechanically activated compacting tool can be designed as a simplified packer (FIG. 5). Besides, the sealing element can be available as a hydraulically activated compacting tool, in particular, a packer expanding upon the environmental pressure impact. It also can be designed as a toroid element connected by a pump to a liquid reservoir installed on the earth surface. The filter can additionally include a bypass tube mounted at the filter external surface (FIG. 6).

BEST MODE FOR CARRYING OUT THE INVENTION

These illustrative figures have the following notions: formation 1, fracture 2, casing 3, initial direction of flow 4, direction of flow after collapsible sealing element is broken 5, flow through the submersible pump 6, solid particles 7, pump motor 8, filter housing 9, filtering element 10, intake port 11, section of pump 12, sealing element 13, rubber cup 14, expanding ring 15, elastic energizing element 16, inflatable rubber packer 17, protective sheath 18, thin rubber layer 19, armored elastic layer 20, remains of broken armored layer 21, pressure feeding line 22, accumulating chamber for liquid 23, bypass tube 24, port 25, filtering volume 26, outside surface of filter 27, temporary plug 28.

The disclosed filter design intended for furnishing submersible motor-driven pumps by attaching the said filter to the bottom section of the mechanical structure of the submersible motor-driven pump. The filter housing 9 is an elongated cylinder. Since the diameter of the filter is slightly lower that the diameter of the pump housing, this ensures a sufficient clearance between the filer and casing 3. In the preferred design embodiment, wellbore fluid is injected to the filter inner channel through a number of intake ports 11. A flexible sealing element 13, mounted at the filter bottom, prevents the flow 5 directly to the outer space between the filter strainer and the housing.

In the basic embodiment of the design, fluid enters the filter though its bottom. Passing a certain distance upwards in the filter, the fluid spreads in the radial direction through a cylindrical filtering element 10 to the space between the filter and the housing: while passing through the filtering element, "large-sized" solid particles 7 are blocked at filtering surface. Thereafter the fluid flows between the motor 8 and the casing 3 and reaches the suction hole of the pump 12.

Over a certain period of the filter operation, the filter is filled with solid particles 7 and the flow pressure drop increased. A failure to replace timely the filter could hamper the fluid flow passage 6 during the routine operation of the submersible motor-driven pump; as a result, the pump can be damaged and the produced fluid yield drops. In this case, it is expeditious to destroy the temporary sealing element 13, and so the produced fluid 5 will flow directly from the wellbore through the space between the pump and filter to the intake port 11 of the submersible motor-driven pump.

During the pump installation (before commencing the operation), the expandable filtering element 10 is folded. This allows easy lowering of the filter body without damaging the filtering element 10. Various known mechanisms could be applied for this purpose.

In some assembly (design) options of submersible motor-driven pumps, a bypass system of the submersible motor-driven pump could also be combined with the filter. In this case, the elongated section of the flexible coil tubing could be lowered to the central section of the filter to provide backflow circulation of captured particles to remove them from the well. To implement this cleanup procedure, the inside of the filter should be connected to the bypass tube. The detailed description of the whole system is given below. However, the application of this extension could extend the strainer service life with the limitation of the filtrating chamber volume: if the volume is not restricted, the big filter length could create problems for the system installation at a required depth matched to the perforation holes at the filter housing.

A deformable sealing element 13 is typically placed at the filter bottom part and is fixed in the cross-section of a hollow pipe. When the submersible motor-driven pump is being lowered to the well, this sealing device is in folded state. When the pump is installed, the device should be unfolded to block the space between the filter housing and the casing. The sealing element properties allow to withhold an insignificant pressure drop only over a limited period of time (generally, a few weeks). The pressure drop between the opposite sides of the sealing element corresponds to the pressure drop inside the filter (typically, several bars). When a rated service life of the filter is expired, the packing element should be either folded again or destroyed to allow the fluid enter the pump, bypassing the non-operating filter.

As mentioned above, various options of the sealing element are available:

Multilayer sealing unit;

Mechanically activated sealing unit;

Hydraulically activated sealing unit.

The multilayer sealing unit typically comprises at least two elements:

sealing element (made of elastomer) in the form of a cup 14. This layer has a rather high elasticity and is capable of expanding towards the casing. However, in the original state it is pressed down to the bypass pipe. In this compressed configuration, it has a small diameter facilitating the process of lowering the system into the wellbore for installation at the desired depth. This layer can be armored 20 (see above for available options) to form a high-strength, flexible and elastic composite material which will also be used as a guide for fluid delivery into the filter and, simultaneously, prevent the penetration of the fluid on the casing.

It's worth mentioning that this cup-shaped rubber sealing element 13 is similar to cups frequently used in operation of flexible production tubing. In the preferred embodiment, the cup is oriented downwards to provide higher resistance to the pressure drop directed towards the wellhead: if the said orientation of the cup is applied, the pressure drop increases the sealing tightness due to stronger pressing of the cup against the casing. The loss in tightness upon the expiration of a certain time of exposure to wellbore fluid is the key functional capability of this element.

protective layer 19 ("sheath") initially retains the rubber cup in the folded state, pressed against the bypass pipe. This layer can either be single-material layer, or fibers braided in the axial direction of the filter. This layer is not elastic and presses the telescopic filtering element against the bypass pipe. Upon a certain period of life in the well, the protective layer 19 loses its mechanical properties due to chemical impact and/or dissolution by wellbore liquid. Thereafter, the rubber cup 14 unfolds and being pressed to the casing 3 to ensure the required tightness and proper flow direction.

Additionally, a third element acting as an activator for the rubber cup unfolding optimization can also be employed. This activator can be either a layer (continuous or fiber) mounted at the cup top. Preferably, the above-mentioned layer should shrink in one direction (radial) to create a force to unfold the cup. The action of this layer can additionally be strengthened by expandable spacing ring 15 between the cup 16 and the pipe. This ring is capable of expanding upon the influence of the wellbore fluid, and increases the cup-opening force. Over a certain period of time, the activator ring 15 should also lose its performance characteristics due to exposure to the wellbore fluid influence to stop the activator operation.

If the above-mentioned filtering system is employed, the possibility of the filter operation in a bypass configuration, upon the expiration of a certain number of running hours of the filter (when the filter space is clogged with captured solid particles), should be provided for. To allow the bypass mode operation, the action of the sealing device should be cancelled, using the following approaches:

Activator (additional layer) system destruction due to physical or chemical impact of the wellbore fluid. This system can be based, e.g., on the application of fibers being under load to provide tight sealing. Upon expiration of a certain time period, this effect will be suppressed as soon as fibers (or some fibers) dissolve in the wellbore fluid. To lighten the design and control the time of the said effect occurrence, the activator layer can be made of two successively mounted parts: the first part activates more rapidly and shrinks, being exposed to wetting over a certain time period, to develop the stain-state effect. The second part is made of fibers transferring the force from shrinking fibers. However, upon expiration of a certain period of time of contacting with the wellbore fluid, this type of fibers loses its mechanical properties, e.g., due to dissolving.

The rubber cup is fabricated from elastomer which loses mechanical properties upon expiration of a certain period of time of contacting with the wellbore fluid. As a result, the cup loses its ability to keep the pressure drop across its cross-section and shrinks.

One of the available options of the rubber cup fabrication is the application of two layers (ref. to next FIG.): the lower part (internal part of the cup to be stretched due to pressure drop) is made of high-strength fibers, whilst the outer part is made of an elastomer which only ensures tightness and impermeability. Upon expiration of a certain period of time, the fiber structure dissolves and the cup destroys.

In case if a mechanically activated sealing device is employed, the sealing element could be designed either as a rubber cup 14, or a simplified component of a packer 17. In this particular embodiment, it is installed by using a mechanical device which is activated similarly to the packer's activation (due to combined movements in different directions, e.g., upwards/ downwards plus rotation). However, upon expiration of a certain period of the filter operation, the sealing element/packer must be removed, and other technologies shall be used for this purpose, since the submersible motor-driven pump is already installed and the pipe column is fixed in the wellhead equipment taper (to permit this mode of production, the wellhead bore shall also be properly configured). The said sealing element/packer is allowed to be removed due to decline in mechanical strength of rubber as a result of the wellbore fluid's chemical impact on the rubber element of the packer (or fastening system of the sealing element/packer activator).

In case if a hydraulically activated sealing device is employed, the packing element/packer activator mechanism for the preferred embodiment can be substantiated by using an expanding packer. In this case, the initiating pressure can be reached at the pump discharge header. A small manifold (mounted outside the pump and filter) enables to supply the pump's intake pressure to the packer (typically, this manifold is less than 1 cm in diameter). When the pump operates, the packer expands and tightly presses against the casing; as a result, the wellbore fluid is sucked into the filter. In the proposed system, the pressure delivery manifold passes through an accumulating fluid chamber 23. There is a piston moving in the said chamber, with oil below the said piston. The oil volume was selected to ensure the packer expansion. A wellbore fluid delivered directly from the pump discharge port is above the piston. In case is the packer 17 is damaged, the said isolating fluid chamber precludes continuous outflow of a fluid to the inter-wall space; in this case, the piston lowers to stop at the required position, thus blocking the delivery of the wellbore fluid.

Upon expiration of the filter service life, the pressure can be vented from the packer, using the following procedures:

- Packer destruction due to chemical impact of the wellbore fluid;
- Plug expansion in the small-sized connecting manifold to stop pressure setting in the packer. However, after isolating operation, a special bypass valve to vent pressure from the packer during the first shutdown after the plug expansion is required. Thereafter, the packer will not expand any more;
- Wire rope induced pressure manifold isolation.

The filter should be capable of accumulating a large amount of small debris and particles. According to estimates, up to 2 tons of proppant (which corresponds to about 1 $m^3$ volume) could go outside during the proppant backflow (following the formation fracturing). At a standard filter diameter of 100 mm, the required length of the filter could account for about 100 m.

Given this elongated and narrow configuration, the lower part of the filter will soon be clogged with solid particles; once clogged, the upper part of the filter is unable to accumulate solid particles any longer. This local blocking of the front part of a lengthy filtering element by solid particles is known to be a challenge caused by a gravel filling downstream of the screen in lengthy horizontal drain lines. The use of a bypass tube (similarly to a special screen for gravel filling) is one of the ways to exclude the above mentioned blocking.

The bypass tube 24 is installed outside the filter in the inter-wall space with the aim to maximally use the volume of the filter for particles accumulation. The bypass tube 24 is connected to the filter at a standard distance (typically, 0.5 to 5 meters). The connecting passages allow the fluid to flow easily to the accumulating volume. It should be mentioned that since the fluid flow in the filter is directed radially, the pressure loss will be at minimum level.

When the filter should be connected, using the bypass configuration, the sealing cup 14 is destroyed as described above. Then, a fluid flow bypassing the filter is maintained. To increase the cross-section available for the filter-bypassing flow, the bypass tube 24 also provides the axial flow in the inter-wall space, since the both ends of the bypass tube 24 are made by a technology similar for the material of the sealing cup: when the cup is destroyed, the both end plugs of the bypass tube are also destroyed.

The filtering surface can de designed as a standard wire screen for gravel filler laying. However, this design can be a non-optimal one, since the requirement to the filter could vary due to the following circumstances:

- short operating life (e.g., a few weeks, on contrary to one year for a gravel filler).
- capture of only large-sized particles, e.g., proppant or post-perforation debris.
- optimum use of the cross-section for captured particles accumulation (since the wire wrap has a certain thickness, the volume available for particles accumulation decreases).

The proposed filter can be manufactured from a~10 m-length tube. At one end of the tube (at an angle of about 180°), flow passages are bored at equal distances; the other part of the tube acts as a filter. The filtering effect can be reached through application of slotted openings in the tube wall. The above-mentioned slots will act as a filtering element that allows fluid to escape from the filter, but captures particles inside the tube wall. These thin slots can be produced by a laser; another option is a HP jet cutting technology. Obviously, if the slots are very thin, the alignment of these slots is required; however, this is a rater challenging task. The position of the slots could such that the filtering section remains rather endurable to withstand tensile, compressive and torsional loads.

A female thread is cut at the pipe section end. On one side, a pipe union with a female thread is firmly (nondetachable) mounted (force-applied tightening or glue connection. It should be mentioned that generally the last section of the tube (length of about 30 cm) is not modified to accommodate the filter (no holes or slots): this allows the possibility of using a dynamometric wrench to set a required tension torque.

The outer wall of the bypass channel is also connected to the tube at the factory. This connection could be made by welding along the whole length of the connection.

While connecting two filter sections, these sections should be oriented in way so that the bypass tube was sufficiently straight. For this purpose, a properly-shaped metal sheet, which guides the flow as required and eliminates the necessity of providing an ideal sealing, is inserted between two bypass tubes. The said metal sheet can be screwed to the filter piping.

In the proposed design of the filter, a volume available for particles accumulation can be easily controlled dependent on the given well requirements. Besides, a pressure drop across the filter does not grow (or hardly grow) as the filter length increases. Destructible plugs to provide fluid supply to the strainer should be mounted on both sides of the bypass channel.

Another advantage of this configuration is that particles captured are conveyed outside to the surface with a direct use of a motor-driven pump and a filter, during the next well workover. This ensures the cleanliness of the well.

What is claimed is:

1. A well filter for submersible motor-driven pumps, comprising:

an elongated filter housing in which a cylindrical filtering element is installed;

a fixture for fastening the elongated filter housing to a pump;

at least one fluid intake port positioned to allow fluid to enter the elongated filter housing; and a shape-deformable sealing element installed on an outer surface of the elongated filter housing, wherein the shape-deformable sealing element is deigned as a multi-layered sealing tool comprising a cup and an element located on the cup outer surface and which is made of an environment-caused shrinkable material, and the shape-deformable sealing element being transitionable from directing fluid up through an interior of the cylindrical filtering element to enabling fluid flow along an exterior of the elongated filter housing after at least partially filling an interior of the cylindrical filtering element with filtered material.

2. The filter of claim 1, wherein a sealing element which is designed as a multi-layer sealing tool.

3. The filter of claim 2, wherein a sealing element comprises at least two elements, with the first element being an elastic polymer cup-shaped sealing element, and the second element being a protective cover.

4. The filter of claim 3, wherein the flexible sealing element is armored.

5. The filter of claim 3, wherein the protective cover is made of destructible material.

6. The filter of claim 1, wherein the sealing element is designed as a mechanically activated packing tool.

7. The filter of claim 6, wherein the mechanically activated sealing tool is designed as an elastic cup, with a mechanical activator, which actuates as soon as it contacts the wellbore fluid, located in the inner part of the cup.

8. The filter of claim 6, wherein the mechanically activated sealing tool is designed as a packer.

9. The filter of claim 1, wherein the sealing element is designed as a hydraulically activated packing tool.

10. The filter of claim 9, wherein the sealing element is designed as a packer expanding upon external pressure applied.

11. The filter of claim 1, where the filter system additionally includes a bypass tube mounted on the filter outer surface.

12. A well filter for submersible motor-driven pumps, comprising:

an elongated filter housing in which a cylindrical filtering element is installed;

a fixture for fastening the elongated filter housing to a pump;

at least one fluid intake port positioned to allow fluid to enter the elongated filter housing; and a shape-deformable sealing element installed on an outer surface of the elongated filter housing, wherein the shape-deformable sealing element is designed as a multi-layered sealing tool comprising a cup and an element located on the cup outer surface and which is made of an environment-caused shrinkable material.

13. The filter of claim 12, wherein the shape-deformable sealing element comprises an expanding spacing ring mounted on the cup inner surface.

* * * * *